US005267715A

United States Patent [19]

Owen

[11] Patent Number: 5,267,715

[45] Date of Patent: Dec. 7, 1993

[54] PATIO RAIL SHELF BRACKET

[76] Inventor: James D. Owen, 601 E. 28th St., Sioux Falls, S. Dak. 57105

[21] Appl. No.: 835,521

[22] Filed: Feb. 14, 1992

[51] Int. Cl.[5] ..... A47G 29/02

[52] U.S. Cl. ..... 248/235

[58] Field of Search ..... 248/235, 241, 247, 227, 248/228, 298

[56] References Cited

U.S. PATENT DOCUMENTS

| | | | |
|---|---|---|---|
| 1,285,158 | 11/1918 | Haynes | 248/235 X |
| 3,017,155 | 1/1962 | Scarpetti | 248/235 |
| 3,493,208 | 2/1970 | Sato | 248/235 |
| 3,606,229 | 9/1971 | Wall | 248/235 X |
| 4,372,425 | 2/1983 | Murphy | 248/235 X |
| 4,893,363 | 1/1990 | Huff | 248/235 X |
| 4,949,924 | 8/1990 | Carmody | 248/215 |

*Primary Examiner*—David M. Purol
*Attorney, Agent, or Firm*—Leon Gilden

[57] ABSTRACT

A shelf bracket structure is arranged to include a first bracket pair selectively utilized with the second bracket pair for mounting to a support beam relative to a patio rail. The first bracket pair includes a central slot, with first bracket leg members extending orthogonally relative to the slot at lower distal ends of the first brackets, wherein plural pairs of the first bracket legs are arranged to support first bracket support plates thereon in a coplanar relationship. The second brackets each include leg members formed with a second bracket slot to include a leg member orthogonally oriented to the slot at a lower end of the bracket, wherein aligned leg members support a second support shelf plate. The brackets of the bracket pairs are each arranged for configuration as respective first and second shells, with the first shell including a first shell flange received within the second shell formed of a continuous seam for ease of assemblage of the organization. A modified bracket structure includes a securement block utilizing variously configured side walls to accommodate various sizes of support beams between the support block side walls and a generally "Z" shaped modified bracket member.

3 Claims, 4 Drawing Sheets

PATIO RAIL SHELF BRACKET

BACKGROUND OF THE INVENTION

1. Field of the Invention

The field of invention relates to support shelf structure, and more particularly pertains to a new and improved patio rail shelf bracket arranged to permit ease of mounting of a support shelf relative to a patio rail member.

2. Description of the Prior Art

Mounting of exterior support shelves relative to a patio rail is a cumbersome and time consuming procedure. The instant invention attempts to overcome deficiencies of the prior art by providing a bracket structure arranged for the ease of mounting and capturing of a rail between plural pairs of bracket members. Prior art support brackets for railings and the like is exemplified in U.S. Pat. No. 4,949,924 to Carmody.

A support shelf organization is set forth in U.S. Pat. No. 4,779,830 to Phelps utilizing a support mount receiving snap-in plates for supporting shelves thereon.

U.S. Pat. No. 4,533,056 to Kirkorian sets forth a shelf bracket utilizing horizontal legs arranged for mounting within vertical support frames.

As such, it may be appreciated that there continues to be a need for a new and improved patio rail shelf bracket as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bracket apparatus now present in the prior art, the present invention provides a patio rail shelf bracket arranged for receiving a patio rail within respective pairs of mounting brackets for positioning support shelves relative to the mounting brackets. As such, the general purpose of the present invention, which will be described subsequently in greater detail, is to provide a new and improved patio rail shelf bracket which has all the advantages of the prior art bracket apparatus and none of the disadvantages.

To attain this, the present invention provides a shelf bracket structure arranged to include a first bracket pair selectively utilized with the second bracket pair for mounting to a support beam relative to a patio rail. The first bracket pair includes a central slot, with first bracket leg members extending orthogonally relative to the slot at lower distal ends of the first brackets, wherein plural pairs of the first bracket legs are arranged to support first bracket support plates thereon in a coplanar relationship. The second brackets each include leg members formed with a second bracket slot to include a leg member orthogonally oriented to the slot at a lower end of the bracket, wherein aligned leg members support a second support shelf plate. The brackets of the bracket piars are each arranged for configuration as respective first and second shells, with the first shell including a first shell flange received within the second shell formed of a continuous seam for ease of assemblage of the organization. A modified bracket structure includes a securement block utilizing variously configured side walls to accommodate various sizes of support beams between the support block side walls and a generally "Z" shaped modified bracket member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved patio rail shelf bracket which has all the advantages of the prior art bracket apparatus and none of the disadvantages.

It is another object of the present invention to provide a new and improved patio rail shelf bracket which may be easily and efficiently manufactured and marketed.

It is a further object of the present invention to provide a new and improved patio rail shelf bracket which is of a durable and reliable construction.

An even further object of the present invention is to provide a new and improved patio rail shelf bracket which is susceptible of a low cost of manufacture with regard to both materials and labor, and which accordingly is then susceptible of low prices of sale to the consuming public, thereby making such patio rail shelf brackets economically available to the buying public.

Still yet another object of the present invention is to provide a new and improved patio rail shelf bracket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
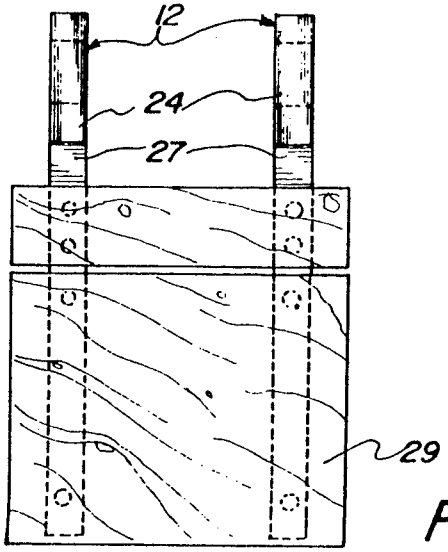
FIG. 1 is an orthographic top view of a second bracket pair.

With reference now to the drawings, and in particular to FIGS. 1 to 10 thereof, a new and improved patio rail shelf bracket embodying the principles and concepts of the present invention and generally designated by the reference numerals 10 and 10*a* will be described.

Figure 6:
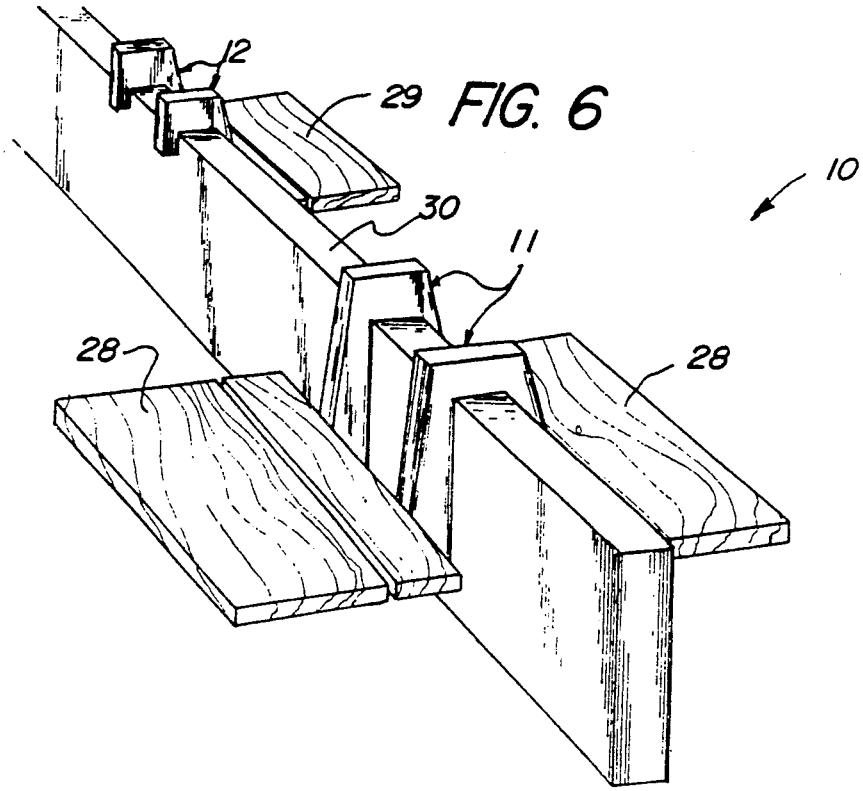
FIG. 6 is an isometric illustration of the invention utilizing the first and second bracket pairs mounted to a respective support beam.
Figure 8:
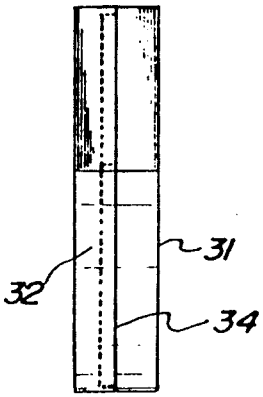
FIG. 8 is an orthographic end view of the bracket halves in an assembled configuration.

More specifically, the patio rail shelf bracket 10, as illustrated in combination in the FIG. 6, includes a first bracket pair 11 cooperative with a second bracket pair 12. The first bracket pair includes a plurality of first bracket members, each including a first central slot 13. The first slot 13 includes spaced parallel and coextensive first slot walls 14, with a first slot abutment wall 15 orthogonally mounted to an upper distal end of each first slot side wall 14. A first bracket top wall 16 is arranged parallel to and above the abutment wall 15. First bracket outer walls 19 are canted downwardly and outwardly relative to the first bracket top wall 16 intersecting first bracket leg top wall 18 of respective first bracket leg members 17 that extend orthogonally relative to the slot 13 and outwardly relative to the first bracket outer wall 19. The first bracket member of the first bracket pair 11, as illustrated in the FIG. 5, includes parallel first bracket member side walls 11*a*.

Each second bracket member of the second bracket pair 12 is formed with the second slot 20, including a second slot first side wall of a first length substantially equal to the first slot side walls 14, with a second bracket second side wall 22 of a second length less than the first length. A second bracket abutment wall 23 is orthogonally oriented relative to an upper distal end of the second bracket first and second side walls 21 and 22 respectively. A second bracket top wall 24 is spaced above and parallel the second slot abutment wall 23 and includes a second leg 25 orthogonally oriented at a lower distal end of a second bracket outer wall 27 defining an obtuse included angle between the second bracket outer wall 27 and the second bracket leg top wall 26. It should be noted that the first bracket leg member top walls 18 and the first bracket outer walls 19 also define an equal obtuse angle, as illustrated in the FIG. 5, in the intersection of the first bracket outer wall 19 with the first bracket leg member top wall 18. The second bracket members each include second bracket member side walls 12*a* that are parallel relative to one another.

First bracket support shelf plates 28 are mounted between adjacent first bracket leg member top walls 18 of adjacent first bracket members of the first bracket pair. Similarly, second bracket support shelf plates 29 are mounted to the adjacent second bracket leg top walls 26 of adjacent second bracket members, in a manner as illustrated in the FIG. 6. Further, a patio support beam 30 is arranged for reception within the first and second slots between the side walls of the respective bracket members for rigidity in positioning of the first and second bracket pairs relative to the support beam in use.

Figure 7:
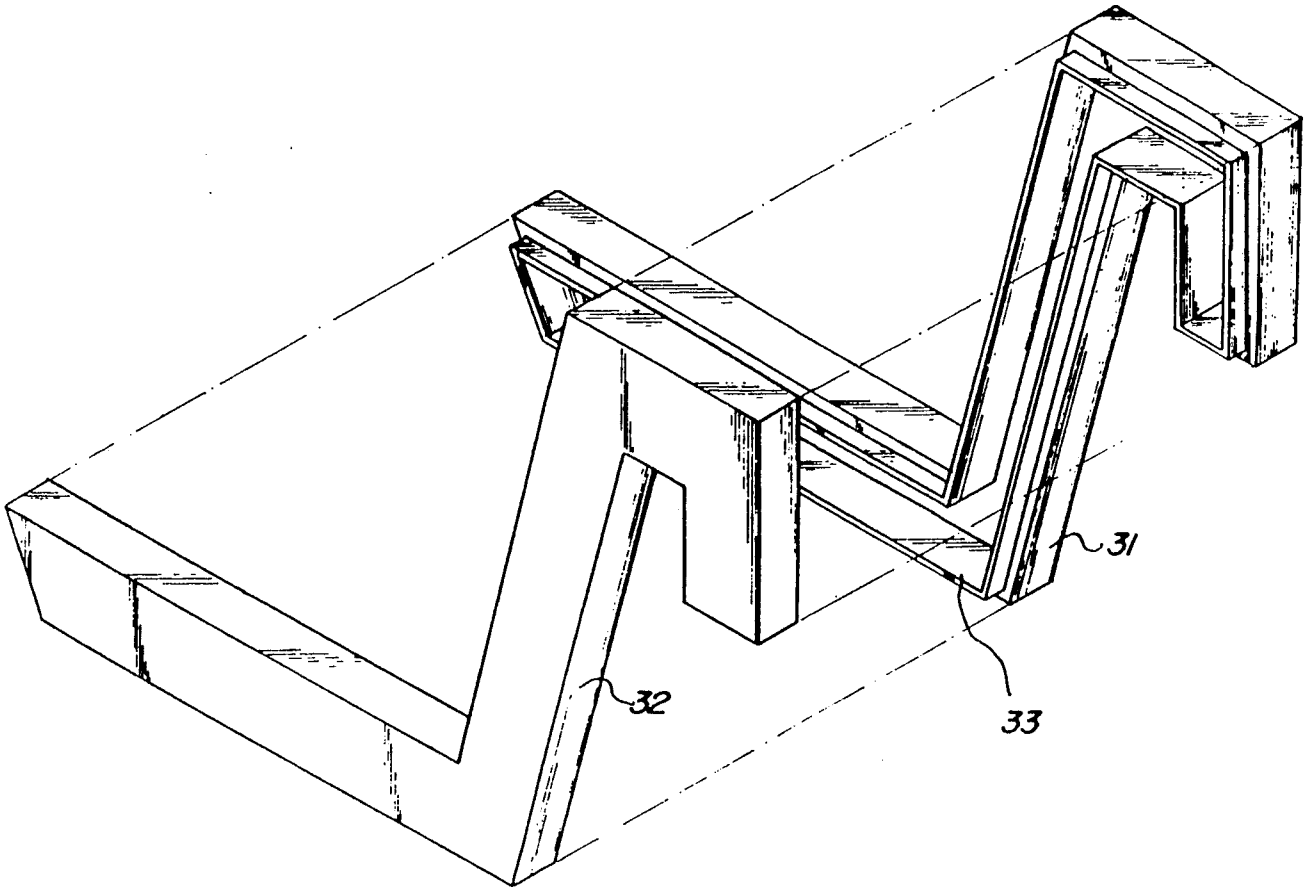
FIG. 7 is an isometric illustration of an exemplary assemblage of the bracket members together.

The FIG. 7 includes a construction for example of the second bracket members together, but it is understood that construction may be equally applied to the first bracket members. Each bracket member is formed of a first bracket first shell 31 and a first bracket second shell 32, with a first shell flange 33 received within the second shell 32 to form a continuous seam 34 for assemblage, such as by sonic welding of the shells together.

Figure 3:
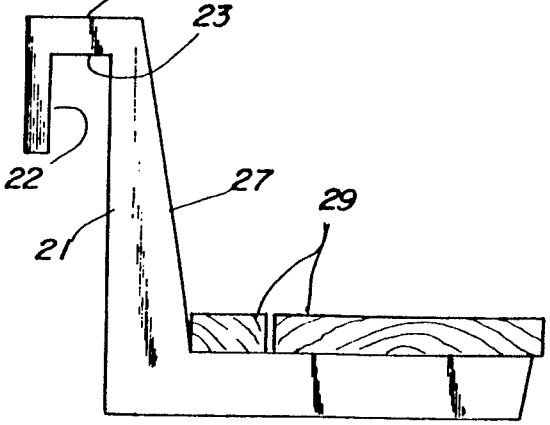
FIG. 3 is an orthographic side view of the second bracket pair.
Figure 2:
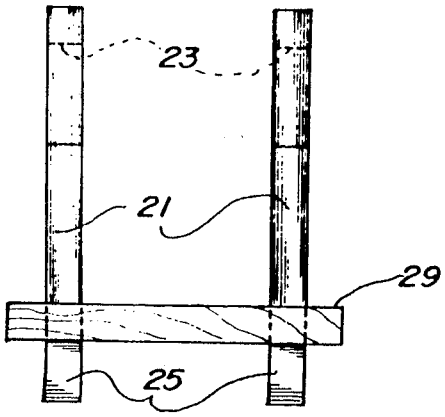
FIG. 2 is an orthographic frontal view of the second bracket pair.
Figure 4:
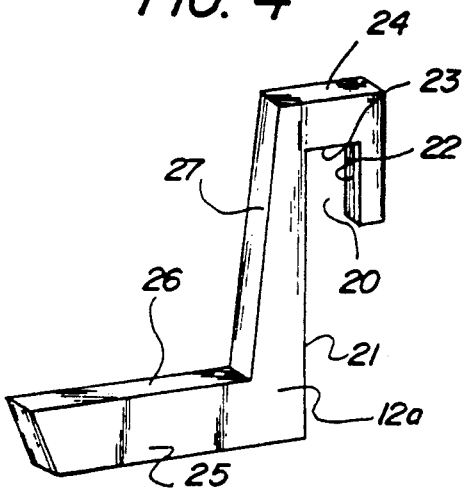
FIG. 4 is an isometric illustration of a bracket member of the second bracket pair.
Figure 5:
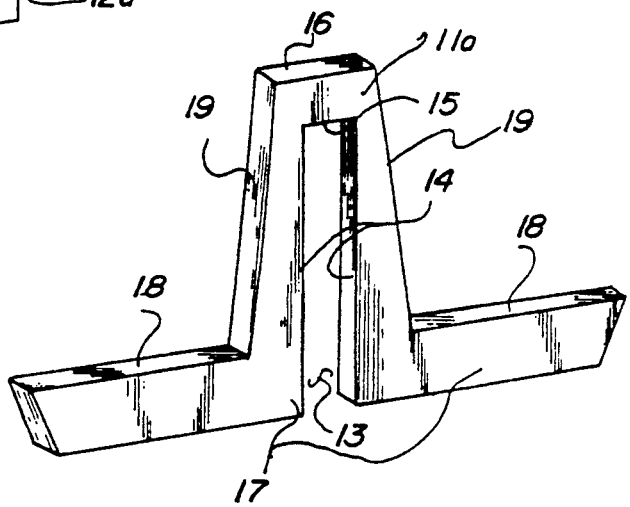
FIG. 5 is an isometric illustration of a further bracket member of a first bracket pair.
Figure 9:
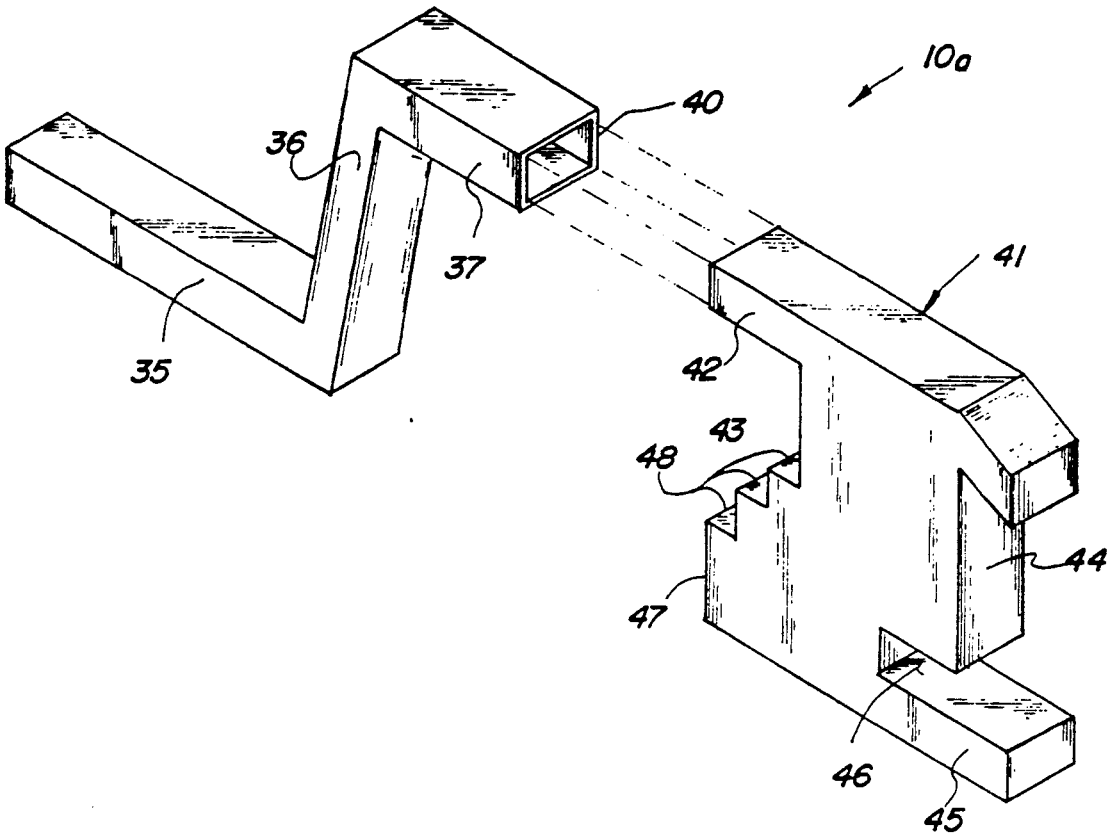
FIG. 9 is an isometric illustration of a modified bracket member assemblage.
Figure 10:
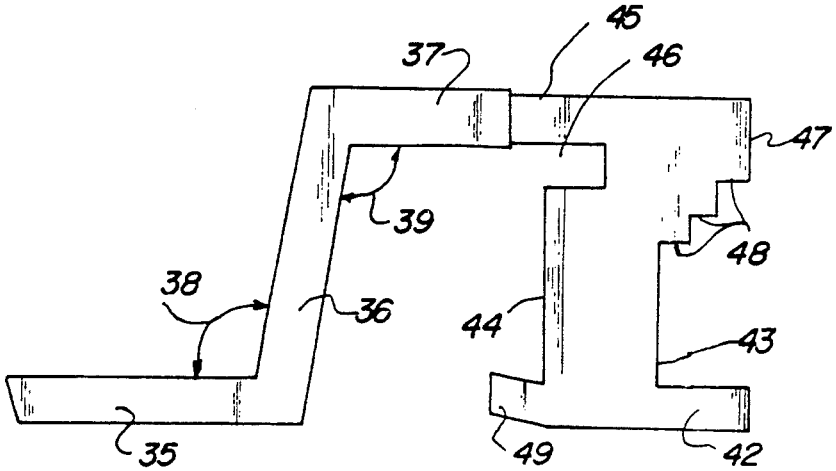
FIG. 10 is an orthographic side view of the bracket member assemblage of FIG. 9 in a second configuration relative to the first configuration, as illustrated in FIG. 9.

The FIGS. 9 and 10 illustrate the use of a further bracket member assemblage for use by the invention. In this configuration, a first support leg 35 is joined to a second support leg 36 that is joined to a third support leg 37 to define a generally "Z" shaped modified bracket member, as illustrated in the FIG. 9. The first and second support legs 35 and 36 are joined to define an obtuse first angle 38, with an obtuse second angle 39 substantially equal to the first obtuse angle 38 defined between the third support leg 37 and the second support leg 36. The third support leg 37 is formed with a third tubular support leg parallelepiped cavity 40 directed longitudinally thereof for securement to a securement block 41. The securement block is formed with parallel side walls with the rail as parallel end walls, with the parallel end walls arranged in confronting relationship relative to the second support leg 36. The securement block includes a first tubular leg 42 formed at an upper distal end of the securement block projecting orthogonally relative to a first end wall 43. A second end wall 44 is spaced from and parallel the first end wall 43, and includes a second tubular leg 45 orthogonally projecting relative to the second end wall, with the second tubular leg 45 spaced below the first tubular leg 42. A second tubular leg slot 46 is formed projecting rearwardly of the second end wall 44 as the second tubular leg 45 originates rearwardly of the second end wall 44. A third end wall 47 arranged coextensively with the outer distal end of the first tubular leg 42 includes a plurality of parallel offset abutment ledges 48 arranged in confronting relationship relative to a top surface of the first tubular leg to permit capturing and positioning of various support beams 30 between the first end wall 43 and the second support leg 36. It should be understood that a plurality of such bracket members and associated securement blocks are utilized to permit accommodation of a support shelf plate structure on the first support legs 35, in a manner such as illustrated in FIG. 3 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bracket organization comprising a plurality of bracket members, each bracket member configured of a generally "Z" shaped configuration, including a first support leg fixedly mounted to a second support leg defining a first obtuse included angle therebetween, the second support leg fixedly mounted to a third support leg, wherein the third support leg and the second support leg define a second obtuse included angle therebetween equal to the first obtuse included angle, and the third support leg including a tubular support leg cavity of generally parallelepiped configuration, and each bracket member further including a securement block securable to the third support leg and received within the parallelepiped cavity.

2. A bracket organization as set forth in claim 1 wherein the securement block includes parallel securement block side walls, and a first end wall spaced from and parallel to a second end wall, the first end wall includes a first tubular leg selectively receivable within the parallelepiped cavity at an upper distal end of the first end wall, and the second end wall including a second tubular leg orthogonally oriented relative to the second end wall at a lower distal end of the second end wall, and the second tubular leg and the second end wall define a slot therebetween, and the first end wall is spaced from a third end wall, the third end wall is arranged coextensive relative to the first tubular leg, and a plurality of parallel offset abutment ledges oriented between the first end wall and the third end wall, wherein the abutment ledges are arranged in confronting relationship relative to the first tubular leg.

3. A patio rail shelf bracket organization, comprising, a bracket pair, including a plurality of bracket members, each bracket member including a slot, the slot including spaced parallel slot side walls, and a slot abutment wall orthogonally oriented relative to upper distal ends of the slot side walls, and a bracket member top wall spaced above and parallel to the slot abutment wall, and a bracket outer wall canted downwardly relative to the bracket member top wall defining an obtuse included angle between the bracket member top wall and the bracket member outer wall, and each bracket member further including a bracket member leg, the bracket member leg orthogonally oriented relative to the slot, and each bracket member leg including a bracket member leg top wall, the bracket member leg top walls of the bracket members are coplanar relative to one another and include a support plate mounted fixedly to the bracket member leg top walls, and the slot side walls are coextensive relative to one another and each bracket member further includes a further outer wall canted downwardly relative to the bracket member top wall, wherein the further outer wall defines a further obtuse included angle equal to the obtuse included angle, and wherein the further outer wall is coextensive relative to the outer wall, and the further outer wall includes a further leg member mounted at a lower distal end thereof, wherein the further leg member includes a further leg member top wall, the further leg member top wall is coplanar with the leg member top wall, and each further leg member top wall is coplanar to receive a further support plate between each further leg member top wall of each bracket member.

* * * * *